US006173463B1

(12) United States Patent
Callahan et al.

(10) Patent No.: US 6,173,463 B1
(45) Date of Patent: Jan. 16, 2001

(54) COT ACCESSORY

(75) Inventors: Michael Callahan; Roger Verhulst; Jeffrey S. Phelps; Ronald D. Nelson, all of Sidney, NE (US)

(73) Assignee: Cabela's Inc., Sidney, NE (US)

( * ) Notice: Under 35 U.S.C. 154(b), the term of this patent shall be extended for 0 days.

(21) Appl. No.: 09/222,334

(22) Filed: Dec. 29, 1998

(51) Int. Cl.[7] ..... H47C 21/00

(52) U.S. Cl. ..... 5/658; 5/110; 5/503.1; 5/505.1

(58) Field of Search ..... 5/503.1, 504.1, 5/505.1, 656, 110, 113, 658

(56) References Cited

U.S. PATENT DOCUMENTS

| | | | | |
|---|---|---|---|---|
| 665,299 | | 1/1901 | Wood . | |
| 800,530 | | 9/1905 | Young . | |
| 1,865,757 | | 7/1932 | Honsowetz . | |
| 2,593,567 | | 4/1952 | Keck . | |
| 2,668,963 | * | 1/1954 | Drake | 5/505.1 |
| 2,889,561 | | 6/1959 | Martin . | |
| 2,960,701 | * | 11/1960 | Nawara | 5/505.1 X |
| 3,334,360 | | 8/1967 | Hoxeng et al. . | |
| 3,835,486 | | 9/1974 | Benoit et al. . | |
| 4,042,232 | * | 8/1977 | Lile et al. | 5/503.1 X |
| 4,686,727 | | 8/1987 | Wilkinson . | |
| 5,094,418 | | 3/1992 | McBarnes, Jr. et al. . | |
| 5,375,276 | | 12/1994 | Nelson et al. . | |

* cited by examiner

*Primary Examiner*—Terry Lee Melius
*Assistant Examiner*—Fredrick Conley
(74) *Attorney, Agent, or Firm*—Bachman & LaPointe, P.C.

(57) ABSTRACT

An accessory for use with a bed or cot having a frame is described. The accessory has a first upright member joined to a first corner of the frame, a second upright member joined to a second corner of the frame, and a variable length cross member connected to the first and second upright members to form a stable, substantially U-shaped structure therewith. Each of the upright members is also connected to a respective leg member of the bed or cot to provide improved stability for the accessory. Further, each upright member has a plurality of hooks for allowing a user to hang clothes, equipment, and other personal items. The cross member is provided with apertures at its ends for receiving the tip portions of the upright members and for allowing the tip portions to extend above the cross member. By allowing the tips of the upright members to extend above the cross member so that a user is able to put slidable devices for holding objects, such as a clothes hanger, on the cross member and not have them slide off the ends of the cross member.

18 Claims, 2 Drawing Sheets

COT ACCESSORY

BACKGROUND OF THE INVENTION

The present invention relates to an accessory for use with a bed, in particular a camping cot, for storing a user's personal items.

Camping has become a very common recreational activity. One of the problems faced by campers is the absence of places to store their personal items. Virtually all cots upon which campers sleep simply consist of a frame supported by a number of legs and a sleeping surface attached to the frame. U.S. Pat. No. 800,530 to Young illustrates this kind of cot structure. Young differs from most cots however in that it includes four corner posts and a pair of parallel side bars for supporting a canopy structure such as mosquito netting. U.S. Pat. No. 665,299 to Wood illustrates a collapsible bed having a similar post and frame system for supporting a canopy.

In hospital situations, it is common to have poles attached to beds to support I.V. bags and other medical equipment. U.S. Pat. No. 1,865,757 to Honsowetz; U.S. Pat. No. 2,889,561 to Martin; U.S. Pat. No. 3,334,360 to Hoxeng et al.; U.S. Pat. No. 3,835,486 to Benoit et al.; U.S. Pat. No. 4,686,727 to Wilkinson; U.S. Pat. No. 5,094,418 to McBarnes, Jr. et al.; and U.S. Pat. No. 5,375,276 to Nelson et al. illustrate some of these pole devices and the manner in which they are attached to a bed.

It has also been suggested in the prior art to provide a bed with a clothes rack attachment. U.S. Pat. No. 2,593,567 to Keck illustrate such an attachment.

Despite the existence of these devices, no one has developed an accessory for storing personal items, such as clothing, firearms, and binoculars, during camping which can be used with a wide variety of cots used by campers.

SUMMARY OF THE INVENTION

Accordingly, it is an object of the present invention to provide an accessory usable with a cot to store a user's personal items.

It is a further object of the present invention to provide an accessory as above which can be used with a wide variety of cots having varying widths.

It is yet a further object of the present invention to provide an accessory as above which is easy to assemble and disassemble.

The foregoing objects are attained by the accessory of the present invention.

In accordance with the present invention, an accessory for use with a bed or cot having a frame comprises a first upright member joined to a first corner of the frame, a second upright member joined to a second corner of the frame, and a variable length cross member connected to the first and second upright members to form a stable, substantially U-shaped structure therewith. Each of the upright members is connected to a respective leg member of the bed or cot as well as the frame to provide improved stability. Further, each upright member has a plurality of hooks for allowing a user to hang clothes, equipment, and other personal items. In a preferred constructions, several of the hooks on one upright member is aligned with several of the hooks on the second upright member so as to form a rack for storing long objects such as hunting rifles and fishing poles. The variable length cross member is provided with apertures at its ends for receiving the tip portions of the upright members and for allowing the tip portions to extend above the cross member.

By allowing the tip portions of the upright members to extend above the cross member, a user is able to place clothes hangers and the like on the cross member and not have them slide off the ends of the cross member.

Other details of the accessory of the present invention, as well as other advantages and objects thereto, are set forth in the following detailed description and the accompanying drawings, in which like reference numerals depict like elements.

DETAILED DESCRIPTION OF THE PREFERRED EMBODIMENT(S)

While the present invention will be described in the context of an accessory for a cot, it should be recognized that the accessory of the present invention could be used with a wide variety of beds including those used at home, in a dorm room, or in hospitals.

Figure 2:
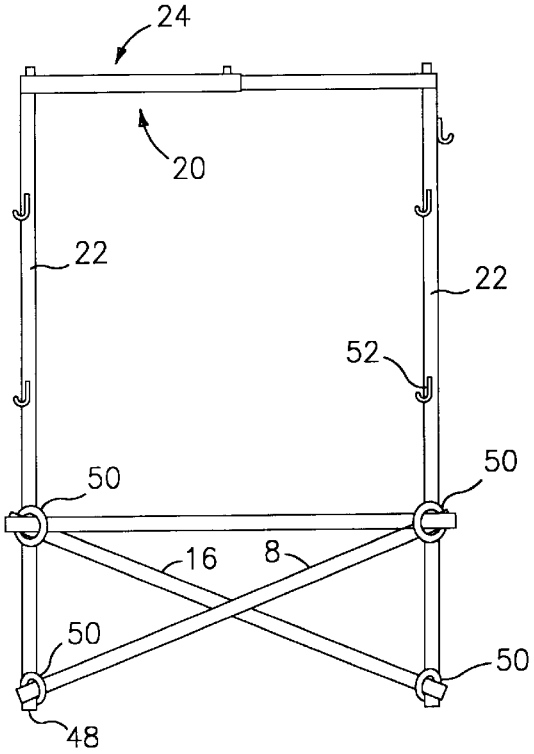
FIG. 2 is an end view of the cot of FIG. 1 showing the accessory of the present invention connected to it.
Figure 1:
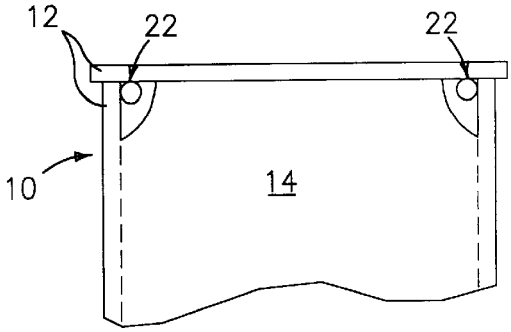
FIG. 1 is a top view of a cot having the accessory of the present invention connected to it.

Referring now to the drawings, FIG. 1 illustrates a cot 10 having a rectangular shaped frame 12 and a surface 14 for supporting a user. The surface 14 may be joined to the frame 12 in any suitable manner known in the art. The cot 10 further includes a pair of leg members 16 and 18 at each end of the frame. The leg members 16 and 18 of each pair extend diagonally from the frame 12 as shown in FIG. 2 and are connected to each other at the approximate mid-point of their extent in a known manner.

The accessory 20 of the present invention has two upright members 22 and a variable length cross member or ridge pole 24. The accessory 20 includes the variable length cross member 24 so that it can be used in a universal manner with cots having differing widths. When joined together, the upright members 22 and the cross member 24 form a stable, substantially U-shaped structure which can be attached to either the head end or the foot end of the cot 10.

Figure 5:
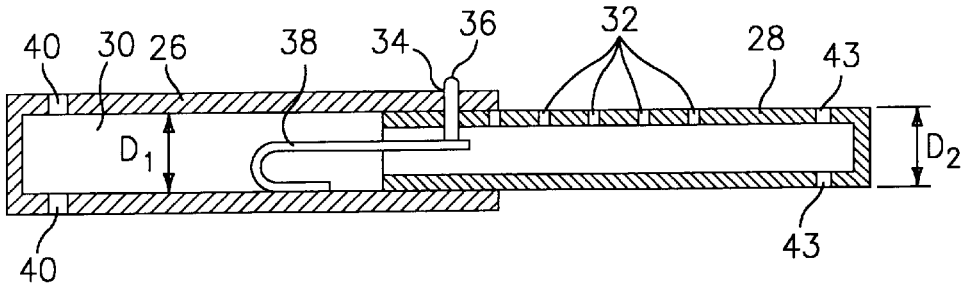
FIG. 5 is a sectional view of a portion of the ridge pole of FIG. 4.

The upright members 22 are each preferably formed from a hollow tubular member formed from a lightweight material such as aluminum or an aluminum alloy. The cross member 24 is preferably formed by a tubular base member 26 and a tubular telescoping member 28. As shown in FIG. 5, the base member 26 is hollow and has an interior bore 30 with a diameter $D_1$ which is slightly larger than the outer diameter $D_2$ of the telescoping member 28. This allows the tubular member 28 to freely telescope in and out of the member 26.

Figure 4:
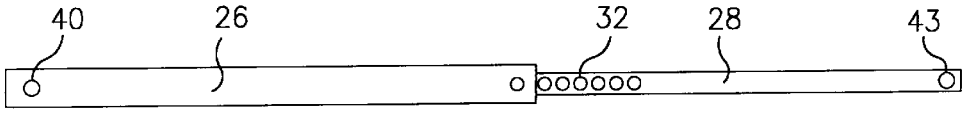
FIG. 4 is a top view of the ridge pole portion of the accessory of the present invention.
Figure 3:
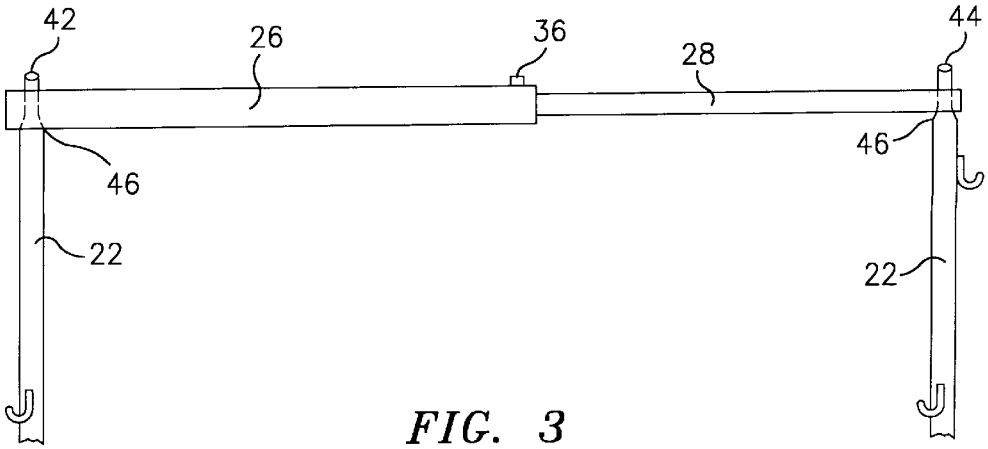
FIG. 3 is a front view of the top end of the accessory of the present invention.

As shown in FIGS. 4 and 5, the tubular member 28 includes a series of apertures 32. When the telescoping member 28 is extended or retracted to a desired length, one of the apertures 32 is aligned with an aperture 34 in the base member 26. A raised portion 36 of a spring clip 38 secured inside the bore 30 passes through both the aperture 34 and the aperture 32 aligned with it to lock the telescoping member 28 in the desired position. The spring clip 38 may be secured to the base member 26 in any suitable manner known in the art.

The base member 26 has a pair of aligned apertures 40 for receiving a tip end 42 of a first one of the upright members 22. The telescoping member 28 has a similar pair of aligned apertures 43 for receiving a tip end 44 of a second one of the upright members 22. As shown in FIG. 4, the tip ends 42 and 44 are tapered so as to form seats 46 on which the cross member 24 can rest when installed. Further, as shown in FIG. 4, the tip ends 42 and 44 extend above the cross member a distance sufficient to prevent items such as hangers sliding on the cross member 24 from sliding off the ends of the cross member. The cross member 24 may be used to hang up a lantern. If desired, wet clothes may be placed over the member 24 so they can dry.

As shown in FIGS. 1 and 2, each upright 22 slides between the cot's frame 12 and the supporting surface 14 and is positioned adjacent a corner of the frame 12. Each upright 22 is attached to the corner of the frame via an attaching strap 50. The attaching strap 50 preferably comprises a strap having a hook and loop fastening arrangement, such as a Velcro fastening system, on its sides. Each strap 50 may be connected to each upright member 22 by any suitable means known in the art such as by a rivet. The strap 50 is wrapped around the frame corner and the upright member 22 to secure the upright member in place.

Each upright member 22 is also attached to the end of one of the legs 16 and 18 by a second strap 50, identical to the first strap in construction. The second strap 50 is wrapped around the end of the leg 16 or 18 and around the upright member 22 to secure the two together. As shown in FIG. 2, each upright member 22 preferably has its bottom end 48 resting on the ground to provide even further stability.

Referring again to FIG. 2, it can be seen that each upright member 22 has a plurality of hooks 52 attached to it, preferably five hooks. The hooks 52 may be secured to each respective upright member 22 by any suitable means known in the art. The hooks allow a user to store objects such as binoculars, packs, guns or canteens by hanging their straps onto the hooks, store coats by their loop members, store articles on hangers, etc. In a preferred construction of the accessory 20, several of the hooks 52 on the upright members 22 may be aligned in height so as to form a rack for holding long items such as fishing poles, hunting rifles, shotguns, and the like.

One of the principal advantages of the accessory 20 of the present invention is that it can be readily assembled and disassembled. For example, the accessory can be assembled by first connecting each upright member to the frame 12 and one of the legs 16 and 18, adjusting the telescoping cross member 24 to the proper length, and placing the cross member 24 over the tips of the upright members. To disassemble the accessory, the assembly process is merely reversed. Yet another advantage to the accessory of the present invention is that it can be used with a wide variety of cots due to the telescoping cross member. This means that a user does not have to dispose of the accessory or purchase replacement parts if he/she has cots of differing widths.

If desired, the tip portions 42 and 44 of the upright members 22 each can be threaded so as to receive a washer and a nut. In this way, a mechanism for clamping and holding the ends of the cross member 24 against the seats 46 can be provided if desired.

It should be recognized that any number of hooks 52 may be attached to each upright member 22. Further, the hooks 52 may be attached to different surfaces of each upright member so as to maximize the storage capability of the accessory 20.

While it is preferred to form the upright members 22 and the cross member 24 from a metallic material, it should be recognized that these members may be formed from other materials such as high strength plastics and plastic composites.

It is apparent that there has been provided in accordance with the present invention a cot accessory which fully satisfies the objects, means and advantages set forth hereinbefore. While the invention has been described in connection with a preferred embodiment thereof, many alternatives, variations and modifications will be apparent to those skilled in the art after reading the detailed description. Accordingly, it is intended to embrace those alternatives, modifications and variations as fall within the broad scope of the appended claims.

What is claimed is:

1. An accessory for a bed having a frame, said accessory comprising:

a first upright member to be joined to a first corner of said bed frame so that said first upright member extends above said bed frame;

a second upright member to be joined to a second corner of said bed frame so that said second upright member extends above said bed frame;

a cross member joined to said first and second upright members so as to form a substantially U-shaped structure with said first and second upright members;

at least one of said upright members having means for holding at least one object; and each of said first and second upright members having a bottom edge which contacts a surface upon which said bed frame rests and being attachable to a respective leg portion of said bed frame adjacent said bottom edge.

2. The accessory of claim 1 further comprising each of said upright members having a plurality of means for holding objects.

3. The accessory of claim 2 wherein said holding means comprises a plurality of axially spaced apart hooks attached to each upright member.

4. The accessory of claim 3 wherein at least one of said hooks on said first upright member is aligned with at least one hook on said second upright member to support an elongated object.

5. The accessory of claim 1 further comprising said cross member being adjustable in length.

6. The accessory of claim 5 wherein said cross member is formed by a base member and a telescoping member and includes means for securing said base member and said telescoping member in an extended position.

7. The accessory of claim 6 wherein said securing means comprises a first aperture in said base member, a spring clip fitted within said base member, said spring clip having an upraised member, and a plurality of apertures in said telescoping member, whereby when said base and telescoping members are in said extended position said upraised member passes through one of said apertures in said telescoping member and said first aperture.

8. The accessory of claim 7 wherein each said upright member is securable to said leg portion by a first strap and is securable to an interior surface of said frame corner by a second strap.

9. The accessory of claim 8 wherein each said strap has a hook and loop fastening system for joining said upright member to a respective one of said frame corner and said leg portion.

10. An accessory for a bed having a frame, said accessory comprising:

a first upright member adapted to be joined to a first corner of said bed frame so that said first upright member extends above said bed frame;

a second upright member adapted to be joined to a second corner of said bed frame so that said second upright member extends above said bed frame;

each of said first and second upright members having a bottom edge which contacts a surface upon which said bed frame rests and being attachable to a respective leg portion of said bed frame adjacent said bottom edge;

a cross member joined to said first and second upright members so as to form a substantially U-shaped structure with said first and second uprights;

said cross member having two spaced apart apertures, a first one of said apertures receiving a tip portion of said first upright member and a second one of said apertures receiving a tip portion of said second upright member; and each of said tip portions extending through one of said apertures and above said cross member so that a user can place a number of objects on said cross member and not have said objects slide off ends of the cross member.

11. The accessory of claim 10 wherein each upright member tip portion is tapered to form a seat for a respective end of said cross member.

12. In combination, a sleeping cot and an accessory for storing a person's possessions, said combination comprising:

said sleeping cot having a substantially rectangular frame for supporting a surface upon which a person can rest;

said frame including leg members secured to said frame;

said accessory comprising a pair of upright members and a ridge pole connecting said upright members to form a substantially U-shaped structure;

each of said upright members having a bottom edge which contacts a surface upon which said bed frame rests and being attached to a respective one of said leg members adjacent said bottom edge; and each said upright member being secured to an interior portion of said frame.

13. The combination of claim 12 further comprising both upright members being positioned adjacent one end of said cot and connected to a respective corner of said frame.

14. The combination of claim 12 further comprising each said upright member having a plurality of hooks for holding the person's possessions.

15. The combination of claim 12 further comprising said ridge pole having an aperture positioned adjacent each of its ends, a tip portion of a respective upright member passing through each aperture and extending above said ridge pole so that a person may place slidable devices for holding objects on the ridge pole and not have said slidable devices slide off said ridge pole.

16. The combination of claim 15 wherein the tip portion of each upright member is tapered so as to form a seat for said ridge pole.

17. The combination of claim 12 wherein said ridge pole is variable in length and is formed from a base member and a telescoping member.

18. The combination of claim 12 wherein said leg members comprise two pairs of crossing members joined to said frame and wherein each upright member is connected to said frame by a first strap connected to said upright member and to an end of one of said crossing members by a second strap connected to said upright member.

* * * * *

UNITED STATES PATENT AND TRADEMARK OFFICE

CERTIFICATE OF CORRECTION

PATENT NO. : 6,173,463 B1
DATED : January 16, 2001
INVENTOR(S) : Michael Callahan et al.

It is certified that error appears in the above-identified patent and that said Letters Patent is hereby corrected as shown below:

Column 4, claim 8,
Line 58, "claim 7" should read -- claim 1 --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*